US006701858B2

(12) United States Patent
Wacker

(10) Patent No.: US 6,701,858 B2
(45) Date of Patent: Mar. 9, 2004

(54) DEVICE TO INTRODUCE THE UPPER THREAD INTO THE EYE OF THE NEEDLE OF A SEWING MACHINE

(75) Inventor: Niklaus Wacker, Steckborn (CH)

(73) Assignee: Fritz Gegauf Aktiengesellschaft Bernina-Nähmaschienenfabrik, Steckborn (CH)

( * ) Notice: Subject to any disclaimer, the term of this patent is extended or adjusted under 35 U.S.C. 154(b) by 0 days.

(21) Appl. No.: 10/126,709

(22) Filed: Apr. 19, 2002

(65) Prior Publication Data

US 2002/0157586 A1 Oct. 31, 2002

(30) Foreign Application Priority Data

Apr. 30, 2001 (CH) ..... 787/01

(51) Int. Cl.[7] ..... D05B 87/02
(52) U.S. Cl. ..... 112/225
(58) Field of Search ..... 112/220, 224, 112/225; 223/99; 7/170

(56) References Cited

U.S. PATENT DOCUMENTS 2,680,418 A * 6/1954 Von Ullisperger ..... 112/225
4,651,660 A * 3/1987 Oshima et al. ..... 112/225
5,615,629 A * 4/1997 Yamada et al. ..... 112/225
6,067,919 A * 5/2000 Shoji ..... 112/225

* cited by examiner

*Primary Examiner*—Ismael Izaguirre
(74) *Attorney, Agent, or Firm*—Volpe and Koenig, P.C.

(57) ABSTRACT

A device to introduce the upper thread into the eye of the needle (7) of a sewing machine which includes two guide clips (49, 51) having two inlet sections (53, 55) ending in a narrow point. The two guide clips (49, 51) are generally identical and can spread evenly when encountering the needle. The grasping hook (57) that lies in a plane in the center of the two guide clips (49, 51) is always guided exactly centered into the eye (25) of the needle (7). In addition, the two guide clips (49, 51) are mounted for tilting movement about a horizontal axis (B).

8 Claims, 10 Drawing Sheets

DEVICE TO INTRODUCE THE UPPER THREAD INTO THE EYE OF THE NEEDLE OF A SEWING MACHINE

BACKGROUND

The object of this invention is a device to introduce the upper thread into the eye of the needle of a sewing machine.

It is difficult, especially for older persons, to thread a needle with a necessarily very small eye. For one thing, one has to have a very steady hand and for another thing the end of the thread to be pushed through the eye must be free of frayed fibers. For this tedious work, there have been devices introduced that thread the eye partially by hand using an assisting device, or filly automatically with the touch of a button. Regardless of whether the threading is done by hand or automatically using a suitable device, a very fine hook is always necessary to grasp the thread on the other side of the eye and to form a loop of thread when pulled through the eye. For fine needles, such as those in common use for household sewing machines, the thickness of the hook is approximately 0.2 mm. This results in the smallest forces exerted on the hook bending it, thus rendering the entire device to which the hook is anchored unusable. These forces exerted on the hook can occur if, for example, the sewing needle is slightly bent and the eye is not in the prescribed position as a result so that the hook tilting into it hits the needle. For this reason, most known threading devices have guide clips or plates to the side of the hook with conically diverging ends.

An example of this can be found in U.S. Pat. No. 2,538,395. The interior sides of the guide clips, i.e. the two surfaces opposite one another, extend parallel to one another and have a separation that is slightly larger than the thickness of the needle. This means that for each needle size, the right size guide clips must be provided. For a thicker needle, it would not be possible for it to be placed in between the guide clips, and for a thinner needle, it would not be centered and thus the hook would be bent. In order to counteract the bending of the hook and to guide a slightly bent needle in between the two guide clips, the threader is hung elastically. The elastic support protects the hook, but—as already mentioned above—not against bending when a non-centered thin needle is grasped.

From U.S. Pat. No. 5,615,629, another fully automatic threading device is known whereby the two guide clips are produced from an elastic sheet material and whose interior sides run parallel to one another. The ends of the two guide clips can be deflected outward and thus enable a centering with respect to the needle. Most fine hooks are, however, not protected against bending by this known device since the needle cannot be exactly centered in the middle between the two guide clips when, as shown explicitly in an example of U.S. Pat. No. 5,615,629 in FIG. 6, one clip deviates, thus no longer guaranteeing that it will meet the eye of the needle lying in the middle.

SUMMARY

The object of this invention is to create a device to introduce the upper thread into the eye of the needle, wherein the hook always lies exactly in the middle between the two guide clips regardless of the position of the needle and regardless of its thickness.

This object is met by a device with guide clips that include two first sections that are parallel to one another and two second sections that converge together at an angle and are adjacent to the first sections. The second sections transition into curved fourth sections whose peaks have a smaller distance from one another than the adjacent first sections. The curved fourth sections are followed by diverging fifth sections. Advantageous embodiments of this invention are further described below.

The similar design of the two guide clips located to the side of the hook, as well as their symmetric suspension makes it possible to always hold the hook located between them exactly at the same distance from the two interior sides of the clips and thus to introduce it into the eye of the needle without contact. Furthermore, the tilting suspension of the plate carrying the guide clips enables an essentially frictionless centering of the two guide clips with respect to the axis of the needle and thus with respect to the eye of the needle. A bent needle will tilt the plate until the guide clips lie symmetric to the needle. The separation of the guide clips at its narrowest point is smaller than the diameter of the thinnest needle. This makes it possible to acceptably center onto the eye of the needle.

BRIEF DESCRIPTION OF THE DRAWINGS

This invention is explained in more detail based on a preferred embodiment. In the drawings.

DETAILED DESCRIPTION OF THE PREFERRED EMBODIMENT

Figure 1:
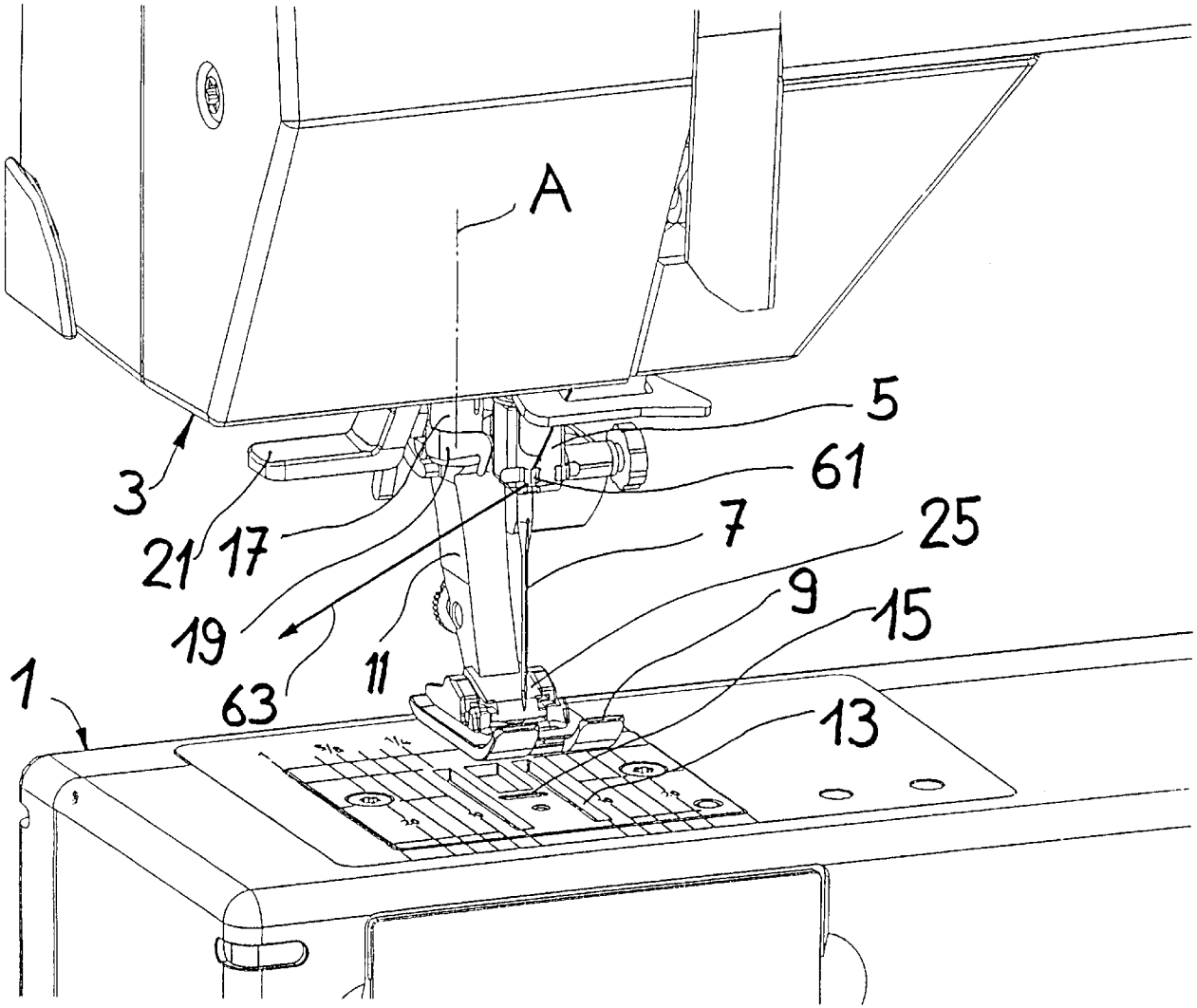
FIG. 1 is a partial view of a sewing machine at the front end of the upper and lower arm with needle post and push sole.
Figure 2:
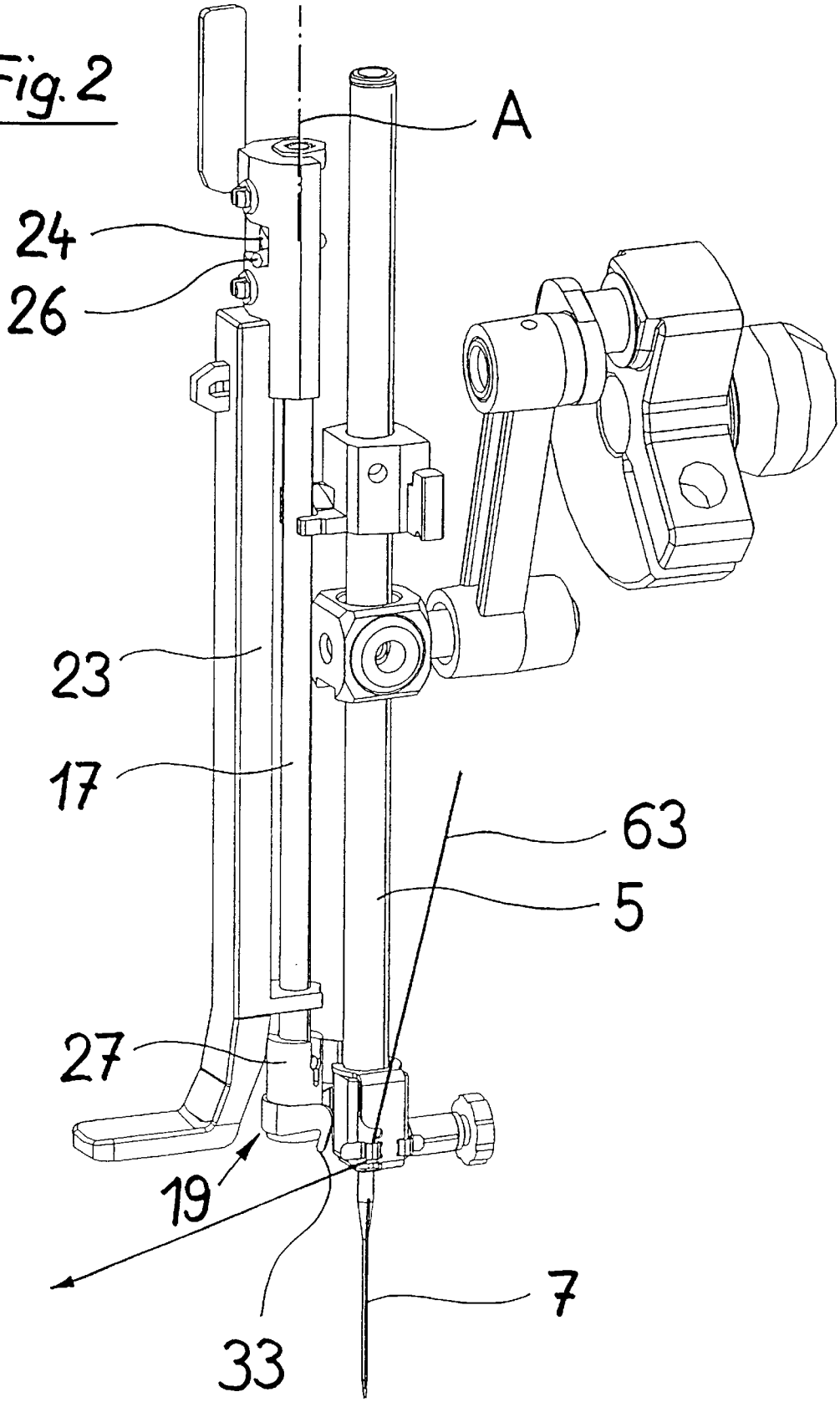
FIG. 2 is an enlarged representation of the needle post and the stem with the threader.

In FIG. 1, the front ends of the lower arm 1, the upper arm 3, the needle holder 5 and the needle 7 are shown, as are a push sole 9 and the push shaft 11 of a household sewing machine, for example. Indicated below the push sole 9 are the openings 13 for the conveyer as well as the stitch hole 15 for the needle 7. To the side of the needle 7 and the needle holder 5 is a threader 19 represented that is fixed, preferably onto the stem 17, said stem 17 moveable vertically at the lower end. The stem 17 with the threader 19 can be lowered to the height of the needle eye 25 by means of a hand lever 21 fastened to the lower end of an actuator 23 (see FIG. 2), and can be rotated in the lowered position about axis A. This rotation is done by means of a coulisse 24 located at the upper section of the actuator 23. A pin 26 that is fastened to the stem 17 engages this coulisse.

Lowering and tilting the threader 19 in the described manner is known from the state of the art. Therefore, it is not described in further detail. A known arrangement can be found in DE 914815.

Figure 3:
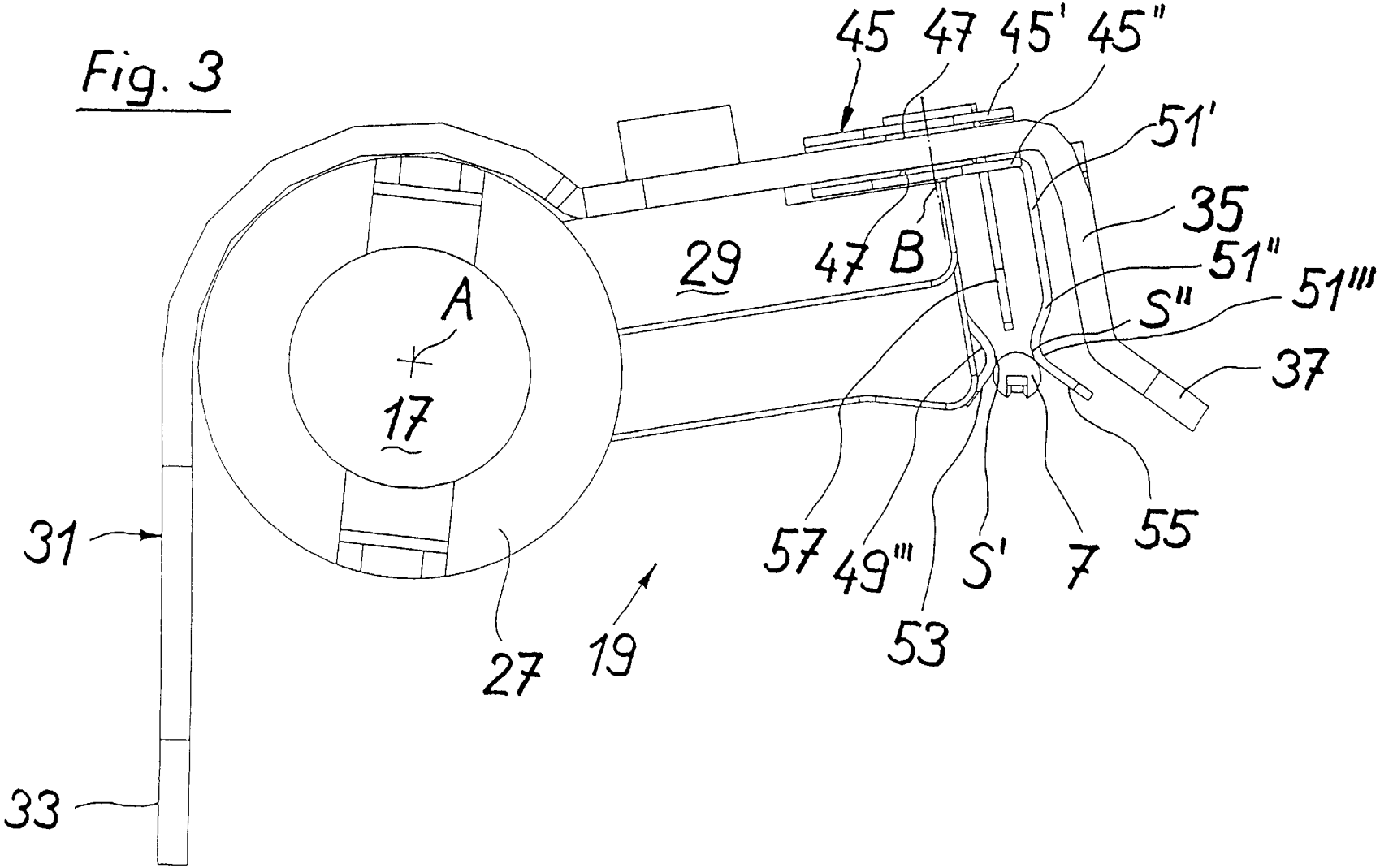
FIG. 3 is a horizontal section view taken along line III—III in FIG. 8 through the threader and the needle when the two guide clips are centered about the needle.

The device, abbreviated as "threader 19", includes a support 27, which in the embodiment shown in FIG. 3 is cylindrical, with which the threader 19 can be coupled to the lower end of the stem 17. A swivel arm 29 is attached to the support 27. The support 27 and the swivel arm 29 are preferably manufactured in a single piece and are preferably made of plastic. A thread guide sheet 31 wraps around both the support 27 to some extent as well as the swivel arm 29 and extends out tangentially over the support 27, in the shape of a downward-facing support bracket 33, and ends to the side of and away from the end of the swivel arm 29 as a bent angled section 35 acting as an feed plate 37. An open V-shaped slit 39 with an adjacent guide curve 41 is mortised into the feed plate 37 (see FIG. 6). The guide curve 41 is shaped like a "V" placed on end as seen from the side. The thread guide sheet 31 is held on the rear of the swivel arm 29 with suitable fasteners. For example, nubs formed on the swivel arm 29 can be provided as the fasteners, said nubs passing through holes 43 in the thread guide sheet 31 and that are connected to the latter by ultrasonic welds.

Figure 6:
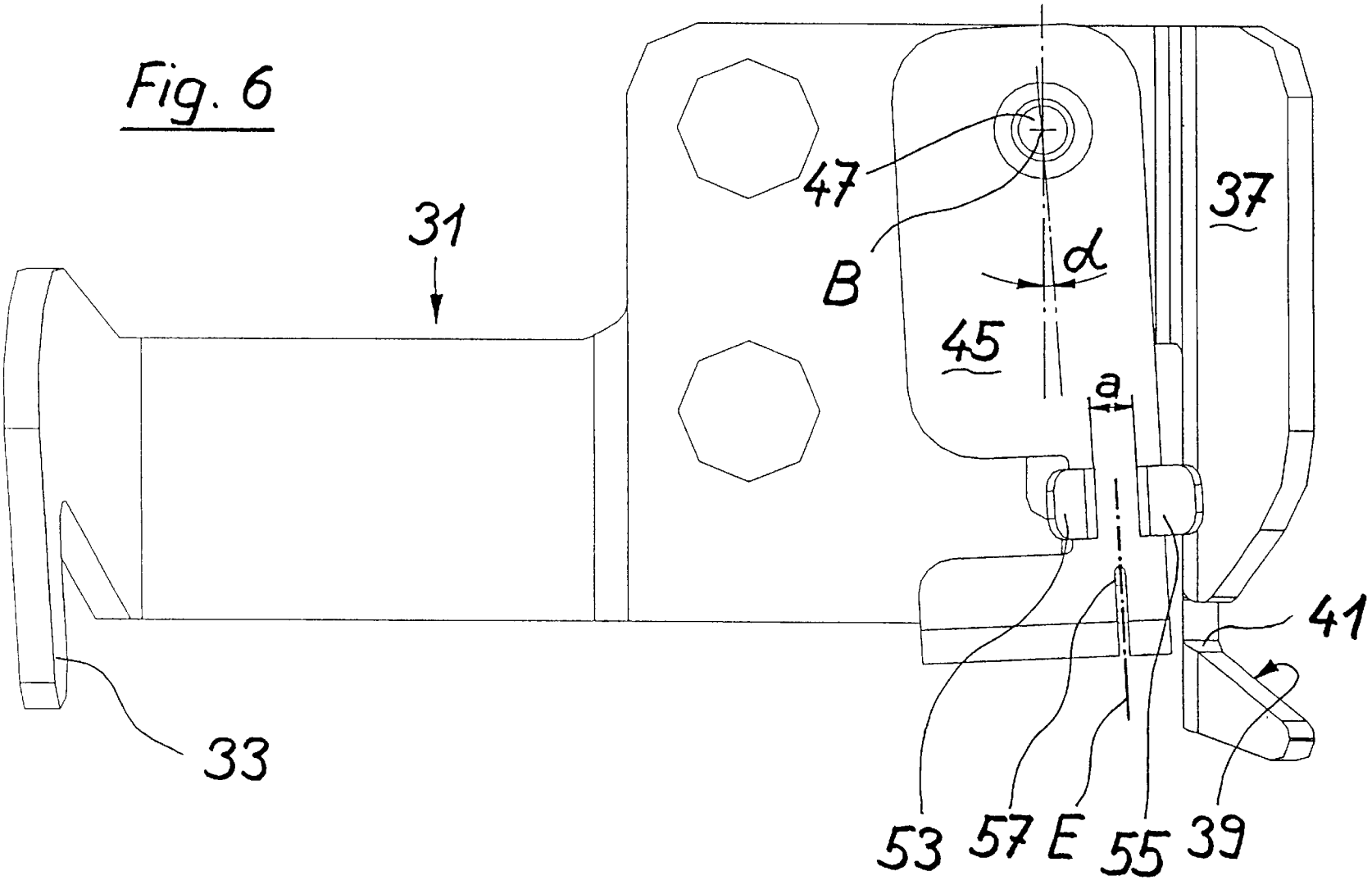
FIG. 6 is a view of the swivel arm with the tilt plate hinged to it and tilted to the side by angle alpha.
Figure 7:
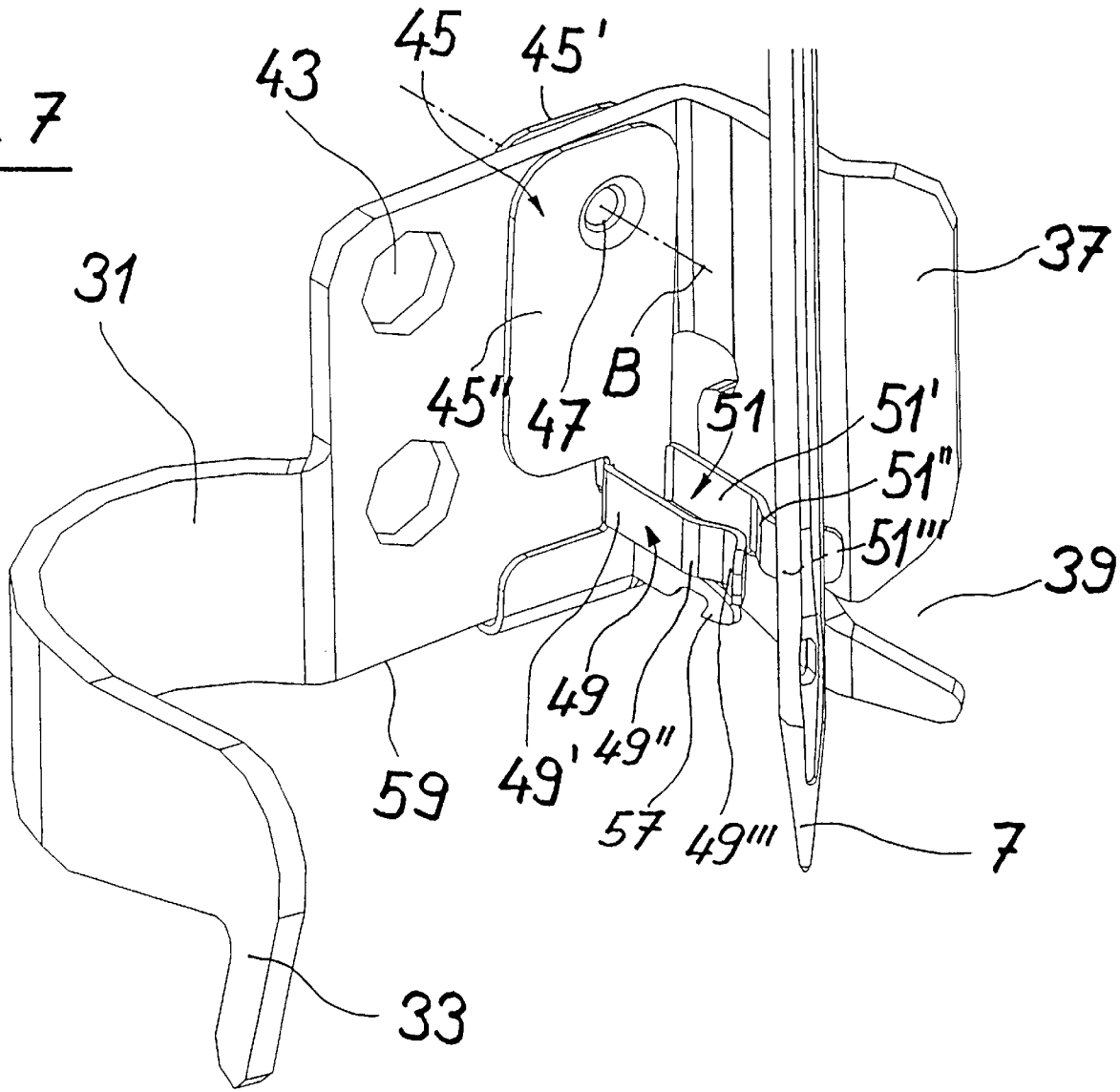
FIG. 7 is an enlarged view of the swivel arm and the plate shortly before the needle centers the guide clips.

A tilting U-shaped plate 45 is fastened (see FIG. 6 also) to the thread guide sheet 31, with the plate being wrapped around the thread guide sheet 31 from below with some play. The plate 45 can be hinged by means of bulges 47 formed on both of its sides 45' and 45" that lie opposite to one another, for example. These bulges 47 mate with a hole (not shown) in the thread guide sheet or in recesses attached to it accordingly. At the side 45", two guide clips 49 and 51 that are at right angles to the surface of the side 45", are being stamped out of the plate 45, which is made of sheet material. See FIG. 7. The two first sections 49' and 51' of the guide clips 49, 51 that directly attach to the side 45" of the plate run parallel and are made from an elastic material. Adjacent to these are the two sections 49" and 51", which converge in a cone shape. Adjacent to this are two curved sections 49'" and 51'" whose peaks S' and S" are separated from one another by distance a, shown in FIG. 6. This distance a represents the narrowest point between the two guide clips 49, 51. The two end sections 53, 55 of the guide clips 49, 51 come after the peaks (S' and S") diverging along a V shape. End section 55 at the right side can be somewhat longer than end section 53 at the left side in a preferred embodiment. Lying in plane E exactly in the center between the two first sections 49', 51' is a thread hook 57 (FIG. 6). The thread hook 57 is not located exactly between the guide clips 49, 51, but is below them and its rear end is fastened to the side 45. The hook 57 is of a very fine design so that it can be passed through the eye 25 of even very thin needles 7, for example of only 0.6 mm width. The thickness of the hook 57 is of the order of magnitude of 0.2 mm. The hook 57 is made of sheet material.

The U-shaped plate 45 is connected at a point far enough from the lower edge 59 of the thread guide sheet 31 so that the plate 45 can be tilted about its tilt axis B, which is formed by the bulge 47 and the hole behind it, within a prescribable range. The tilt range is a few degrees, for example +/−3 degrees.

Figure 4:
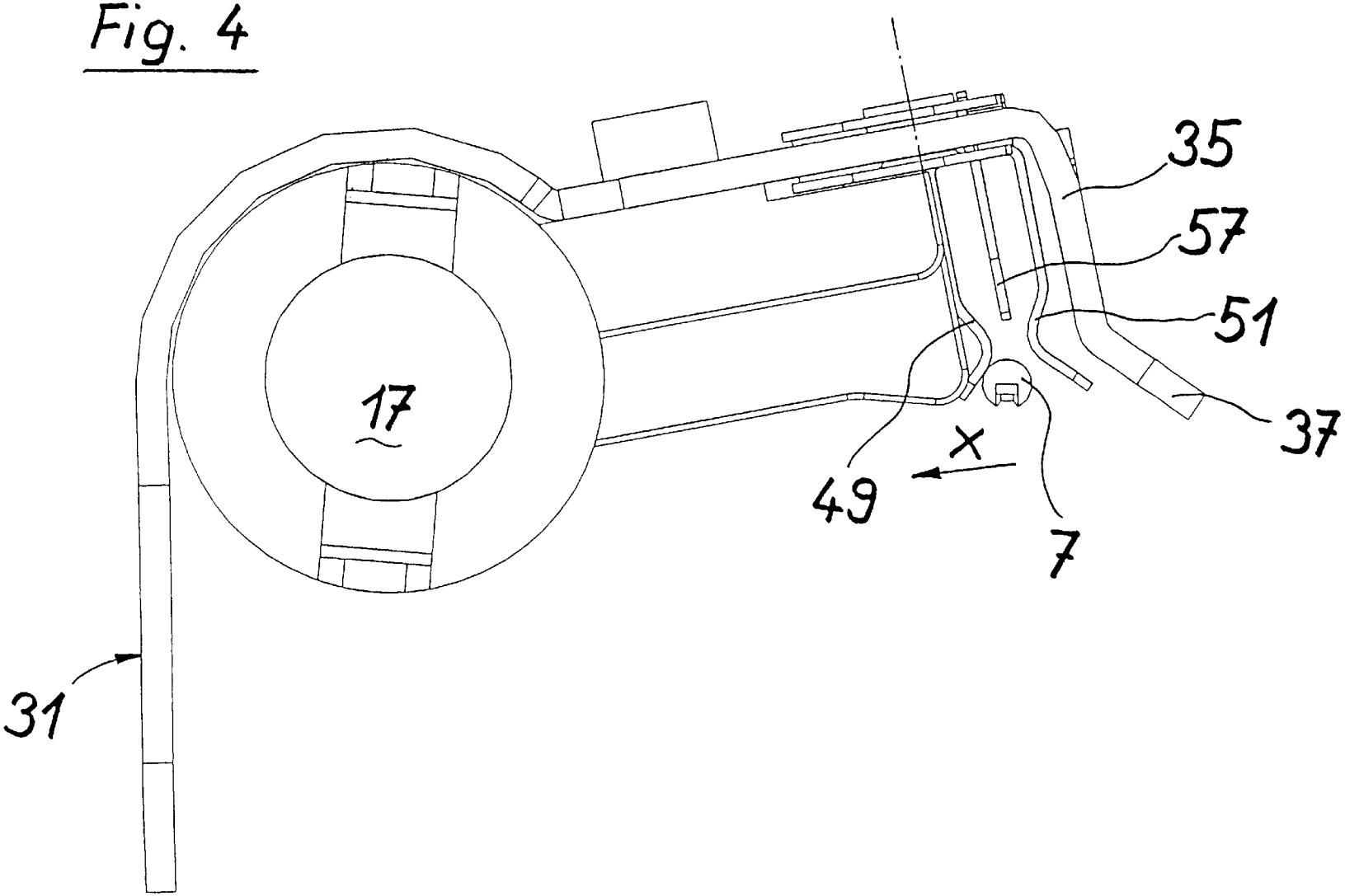
FIG. 4 is a view similar to FIG. 3, but prior to the first contact of the grasping clips with the needle.
Figure 5:
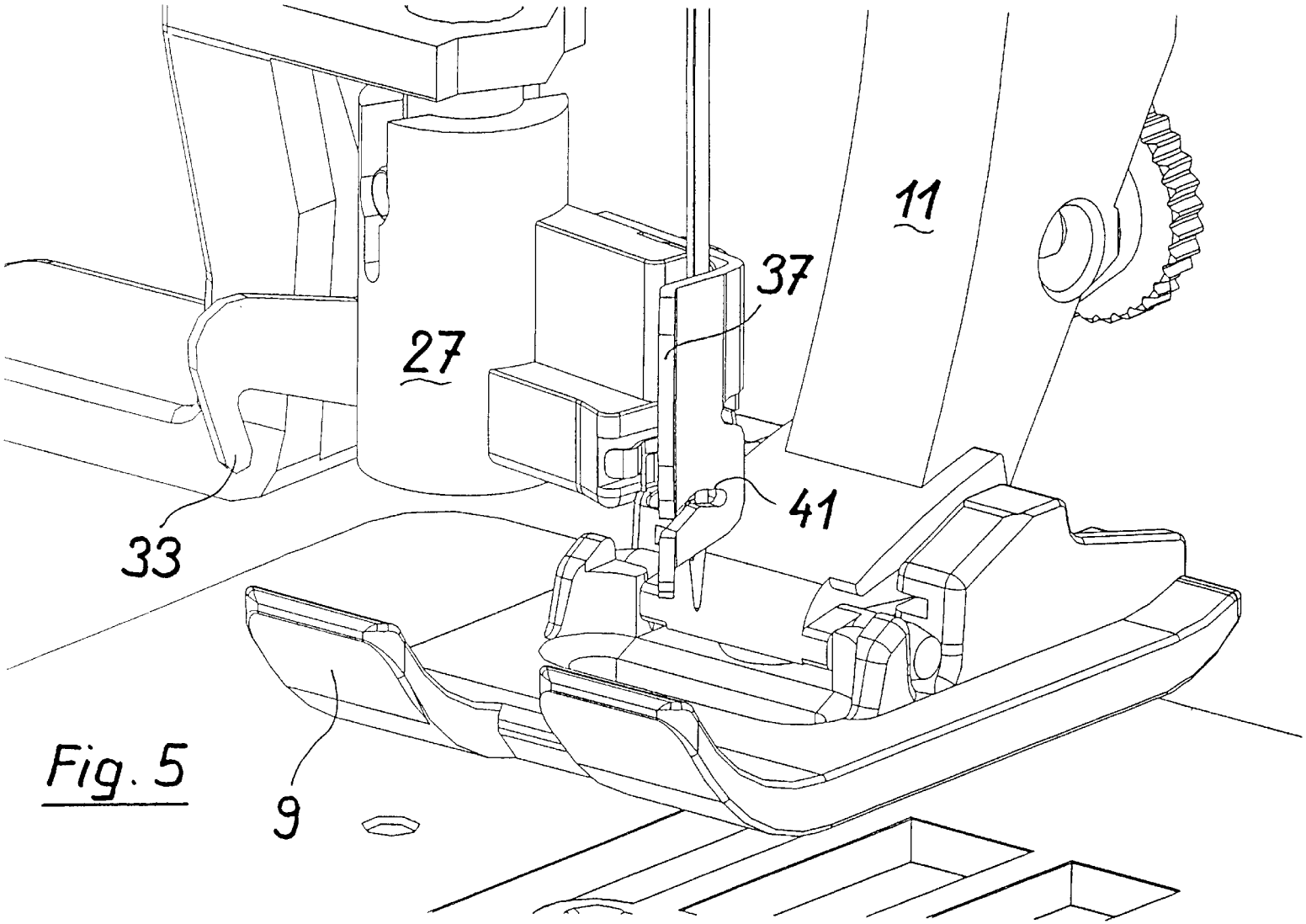
FIG. 5 is an enlarged portion of FIG. 1 with the hook already passed through the eye of the needle.
Figure 10:
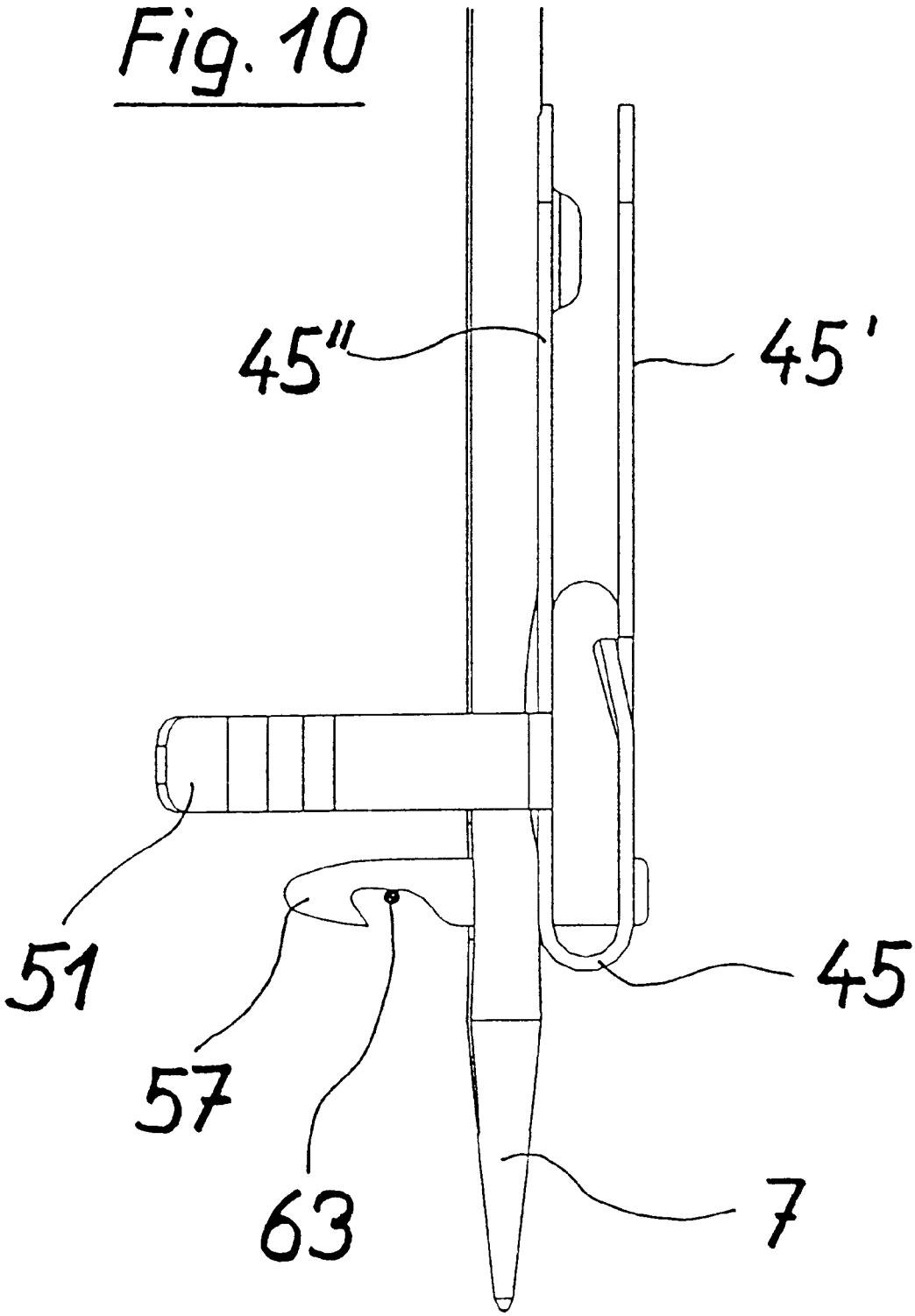
FIG. 10 is a side view of FIG. 9.

Below, the functioning of the threader 19 is described in more detail. In a known fashion, the stem 17, along with the hook 57 fastened to its lower end and the two guide clips 49 and 51, is lowered by pushing down on the hand lever 21 and rotated clockwise shortly before reaching the lowest position. This rotation is accomplished by means of the partially shown coulisse 24 at the upper end of the stem 17. If an unbent needle 7 is present, the two ends 53, 55 of the two guide clips 49, 51 meet the needle 7 at the same time and symmetrically. When the stem 17 is further turned, the two guide clips 49 and 51 are spread apart at the same time and in the same amount and the hook 57 located between the two guide clips 49 and 51 can pass through the eye 25 of the needle 7 without touching it. This ideal initial position is not shown in the figures. If the axis of the needle, however, is located offset with respect to the intended position (see FIG. 3), guide clip 49 encounters the needle first. Due to the force acting on the guide clip 49 in the direction of the arrow x (FIG. 4), the plate 45, to which the two guide clips 49 and 51 as well as the hook 57 are fastened, tilts in a counter clockwise fashion about axis B and centers the two guide clips 49 and 51 about the needle 7. By further rotating the stem 17, the hook 57, which now lies exactly in front of the eye 25 due to the tilting motion of the plate 45, is pushed through it and extends through the eye 25, as shown in FIG. 10.

Figure 8:
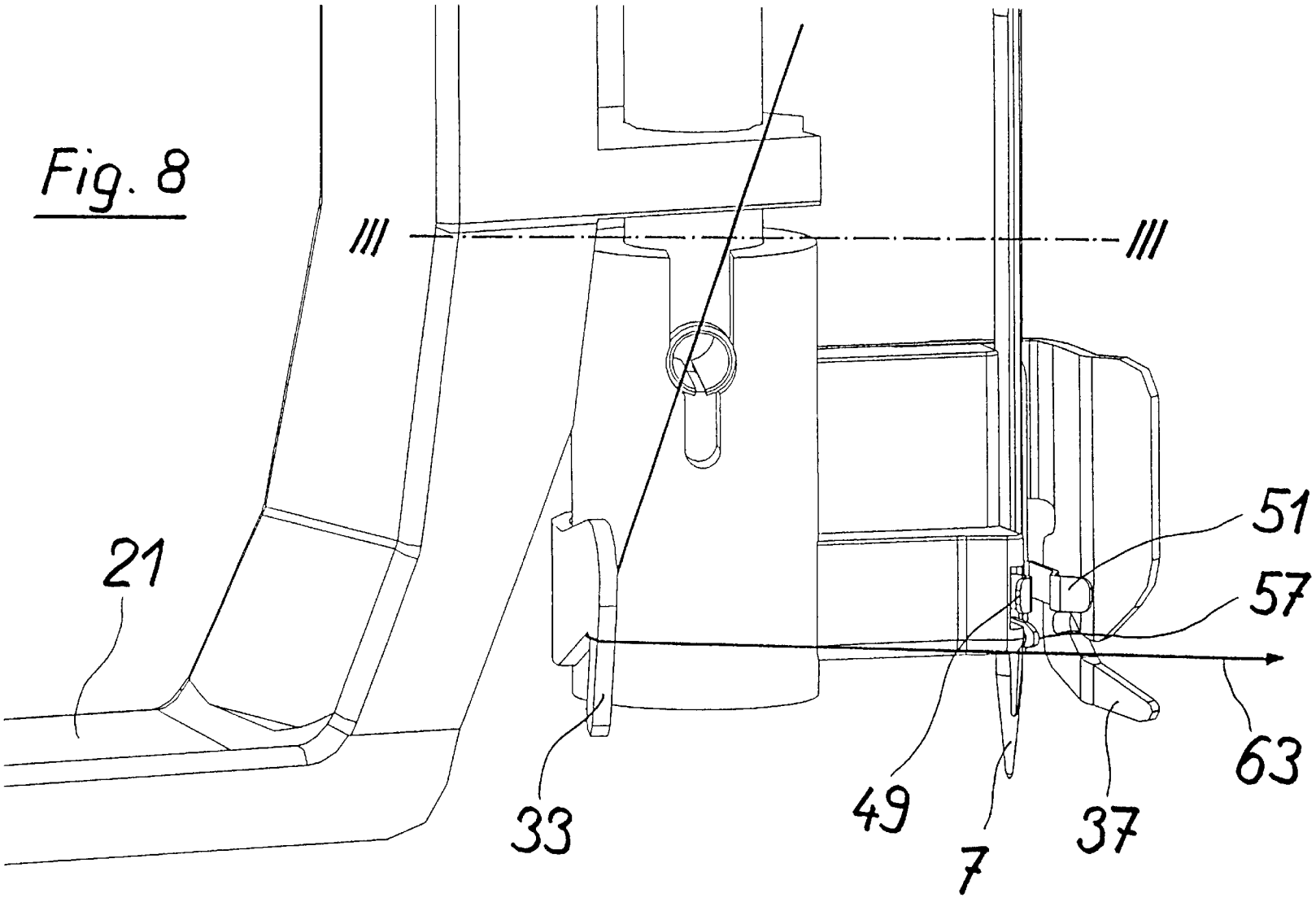
FIG. 8 is a view of the device with the upper thread in place.
Figure 9:
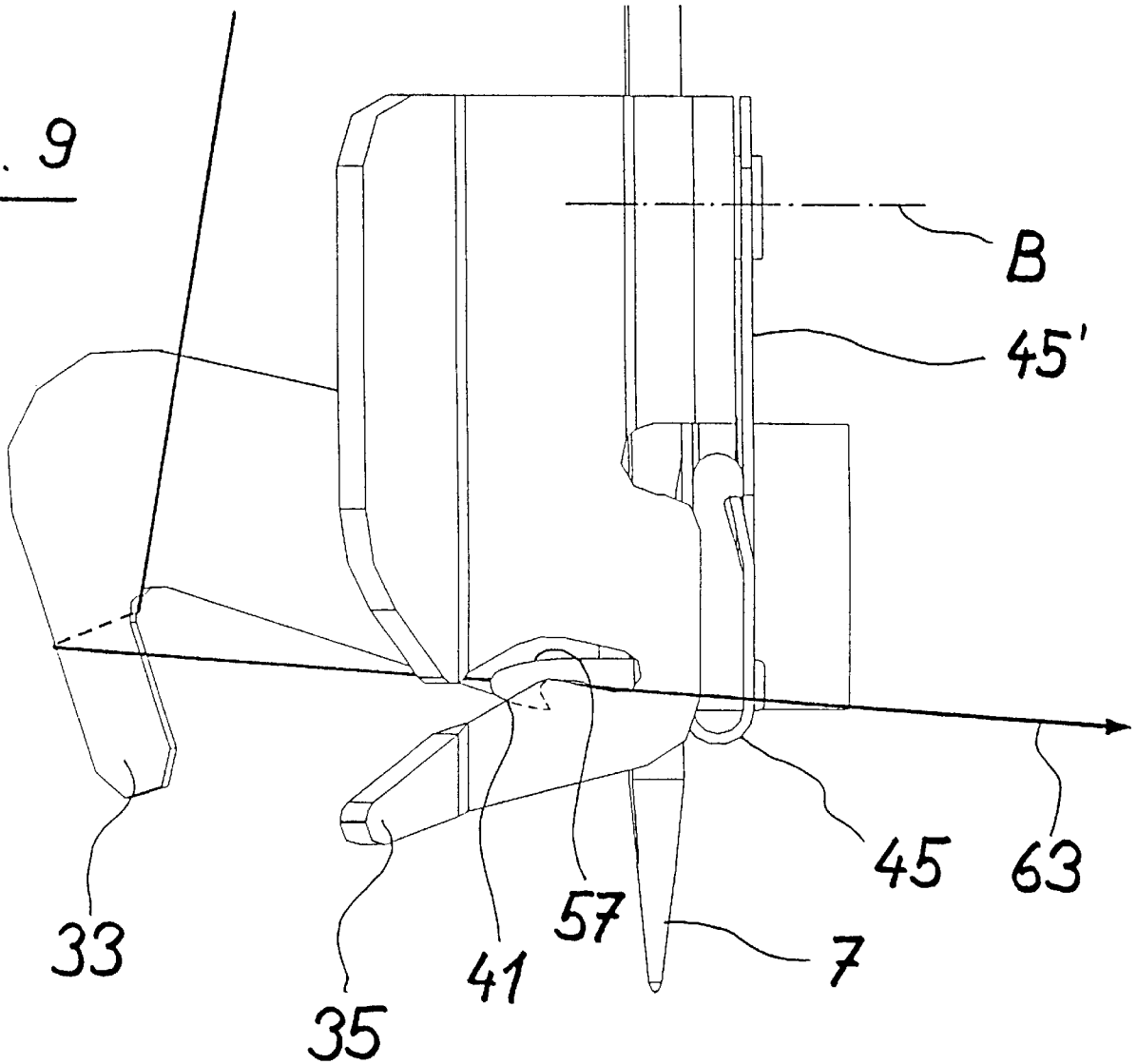
FIG. 9 is a view of the device after the thread hook has grasped the upper thread.

An upper thread 63, which is held in a thread guide 61 at the needle holder 5 of the sewing machine, can be threaded through to the slot 41 under the support bracket 33 and the two guide clips 49 and 51, as shown in FIG. 8. By means of the V-shaped design of the slot 41, the upper thread 63 approaches the hook 57 from below, as shown in FIG. 9. As soon as the pressure is let off of the hand lever 21, the stem 17 tilts back and the hook 57 grasps the upper thread 63 and pulls it through the needle eye 25 and throws it upward after rotating by a few degrees of angle and beginning its vertical motion. The loop formed by the hook 57 can be grasped by hand and the end of the thread can be pulled through the needle eye 25. The threader 19 returns by spring force to its raised protected position beneath the upper arm 3.

What is claimed is:

1. A device to introduce an upper thread (63) into an eve (25) of a needle (7) of a sewing machine, comprising a hook (57) to grasp the upper thread (63), two guide clips (49, 51), one located on each side of the hook (57), a swivel arm (29) moveable about a first axis (A) that holds the hook (57) and the guide clips (49, 51) and that is fastened to a lower end of a rotating guide stem (17) and through which the hook (57) and the guide clips (49, 51) are held and can be moved into and out of an area of the needle (57), the two guide clips (49, 51) and the hook (57) are fastened to a plate (45) that is moveably mounted on the swivel arm (29) for movement about a tilt axis (B), and the two guide clips and the hook are located at a distance from the tilt axis (B) of the plate (45) to allow side-to-side movement of the plate (45) for centering the hook upon either of the two guide clips (49, 51) contacting the needle.

2. A device according to claim 1, wherein the two guide clips (49, 51) are made of an elastic material and have a spring characteristic that is the same at least up to the peaks (S', S").

3. A device according to claim 1, wherein one of the two guide clips (49, 51) has a longer fifth section (53) than the other fifth section (55).

4. A device according to claim 1, wherein the plate (45) is mounted for generally free tilting movement about the tilt axis (B), which is generally horizontal.

5. A device according to claim 1, wherein the plate (45) has at least one bulge (47) that mates with one of a cup-shaped recess and a hole in the thread guide sheet (31), and the at least one bulge (47) and the recess define the tilt axis (B).

6. A device according to claim 5, wherein the plate (45) has a U shape and the at least one bulge (47), is formed into one of two sides (45', 45") of the plate and mates with the at least one of the cup-shaped recess and the a hole in the thread guide sheet (31).

7. A device according to claim 1, wherein the guide clips (49, 51) are made by a stamping or bending process in one piece together with the plate (45).

8. A device according to claim 1, wherein the guide clips (49, 51) include two first sections (49', 51') that are parallel to one another and two second sections that converge together at an angle and are adjacent to the first sections, the second sections transitioning into curved fourth sections (49''', 51''') having peaks (S', S") that have a smaller distance (a) from one another than the two adjacent first sections (49', 51'), and the curved fourth sections (49''', 51''') are followed by diverging fifth sections (53, 55).

* * * * *